US005283996A

United States Patent [19]

Myers

[11] Patent Number: 5,283,996

[45] Date of Patent: Feb. 8, 1994

[54] INTERLOCKING GROUND COVER

[76] Inventor: Raymond T. Myers, 2609 S. El Camino Real, San Clemente, Calif. 92672

[21] Appl. No.: 870,291

[22] Filed: Apr. 17, 1992

[51] Int. Cl.[5] ..... E04C 2/04

[52] U.S. Cl. ..... 52/223.6; 52/223.14; 52/596; 52/677; 249/83; 249/93; 425/111

[58] Field of Search ..... 52/223.6, 223.7, 223.14, 52/596, 677; 249/83, 91, 93, 94, 97; 425/111

[56] References Cited

U.S. PATENT DOCUMENTS

| | | | |
|---|---|---|---|
| 1,580,485 | 4/1926 | Hahn | 249/91 |
| 1,597,373 | 8/1926 | Grimm | 249/83 X |
| 2,618,960 | 11/1952 | Orzel | 52/223.6 X |
| 2,892,340 | 6/1959 | Fort | 52/223.7 |
| 3,195,277 | 7/1965 | Greulich | 52/223.6 |
| 4,119,695 | 10/1978 | Asserback | 249/91 X |
| 4,644,726 | 2/1987 | Wheeler | 52/677 |
| 4,718,839 | 1/1988 | Paakkinen | 249/83 X |
| 5,074,085 | 12/1991 | Ueda | 52/220.3 X |

*Primary Examiner*—Carl D. Friedman
*Assistant Examiner*—Robert Canfield
*Attorney, Agent, or Firm*—Christie, Parker & Hale

[57] ABSTRACT

The invention relates to a prestressed concrete slab and a method for preparing the slab. The slab comprises a corner post at each of its corners. The corner post comprises a cylindrical member; means of attaching and securing reinforcing members to the corner posts; means of attaching each slab to another slab; and means of tensioning the reinforcing members. The slab further includes a center post. The center post comprises a cylindrical member and means of attaching and securing reinforcing members to the center post. Reinforcing members are attached to the corner post and the center posts to connect each to the other. Concrete is set and cured between the corner posts and around the center post and the reinforcing members to form a slab.

11 Claims, 5 Drawing Sheets

INTERLOCKING GROUND COVER

FIELD OF THE INVENTION

The present invention relates to a method for making prestressed concrete slabs by pretensioning that is simple and does not require a high degree of skill.

BACKGROUND OF THE INVENTION

The most common technique for reinforcing concrete involves the inclusion of tendons of wire mesh or steel rods in a formed slab. Prestressed concrete has long been a popular construction material due to the reduced amount of concrete used in a slab, which significantly reduces the weight of the slab. Prestressing can be achieved by the use of two general techniques: post-tensioning and pretensioning. Pretensioning is achieved by using reinforcing tendons of high tensile strength in a pouring mold. The tendons are tensioned, and the liquid concrete is poured into the mold encasing the tendons. When the concrete is set and cured, the tension on the tendons is released. The tension of the prestressed tendons exerts a tensile force on the surrounding concrete, imparting to it a tensile strength vastly superior to that of ordinary, reinforced concrete.

Pretensioning requires the use of a strong mold to withstand the force of the tension on the tendons. Tensioning of the tendons is usually achieved by means of anchoring one end of the tendon to the mold and applying force to the other end of the tendon by means of a device such as a hydraulic jack. When optimum force is attained, the unanchored end is anchored to the mold. Such procedures generally require a great degree of care and skill in preparation and are generally practiced in factory casting.

Post-tensioning is performed after the concrete slab is set and cured. The cables or rods, treated to prevent the concrete from adhering to them, are tensioned and anchored to the outer surface of the concrete slab. Post-tensioning is a simple and inexpensive means of prestressing concrete, and may easily be carried out on site. However, it suffers from creep of the tendons, resulting in loss of tension in the tendons.

The scale and cost associated with most prestressing of concrete precludes its use by most homeowners or handimen on small scale projects. The strength available from prestressed concrete may be used on a small scale for various home and garden projects.

There exists a need, therefore, for a method of preparing prestressed concrete that does not result in a loss of tension in the tendons and that is easy to perform, on site, by people, such as the home handyman, who do not possess a high degree of skill or expensive equipment. It is also desirable that the means of attaching the slabs together can also be performed without a high degree of skill or the need for expensive equipment.

SUMMARY OF THE INVENTION

The present invention relates to a prestressed concrete slab and a method for making such slabs. A multi-sided mold in which the concrete will be poored, provides a frame for prestressing of reinforcing members. A plurality of tensioning posts are provided which are positioned adjacent the frame for attachment to tensioning devices, such as bolts extending through the mold. Reinforcing members are captured by the posts and extend between adjacent posts. A central tensioning post located substantially centrally in the mold, captures reinforcing members extending from each of the tensioning posts positioned next to the mold.

Tightening of the tensioning devices in the mold places the reinforcing members under tension by drawing the tensioning posts toward the mold wall thereby increasing the distance between adjacent posts and the center post to induce tension in the captured reinforcing members.

In a specific embodiment, defining means for capturing the tensioning members, the slabs are made in a rectangular mold in which a corner post is positioned at each corner of the mold. The corner posts include a cylindrical member having a cylindrical open core. At least one slot is cut across the diameter of each end of the cylindrical member and is provided for wrapping and holding reinforcing members. At least one aperture is provided in the side of the corner posts for attaching the corner post to the mold and for tensioning the reinforcing members.

A center post is provided at the intersection of the diagonals between the corner posts. The center post comprises a cylindrical member having a cylindrical open core and at least two slots across the diameter of each end of the cylindrical member. The slots are provided for wrapping and for holding reinforcing members.

The reinforcing members are wrapped around the upper and lower ends of the corner and center posts. Once the reinforcing members are in place, a plug is inserted into the upper end and the lower end of the cylindrical core of each of the corner and center posts, to retain and secure the reinforcing member. Once in place, the reinforcing members are tensioned by screwing a bolt or similar device through the mold and into the aperture of the corner posts, forcing the corner posts into the corner of the mold.

Concrete is set and cured between the corner posts and around the center posts and the reinforcing members. After curing, the bolts are removed, and the prestressed concrete slab is released from the mold, ready for use.

DETAILED DESCRIPTION

Figure 1:
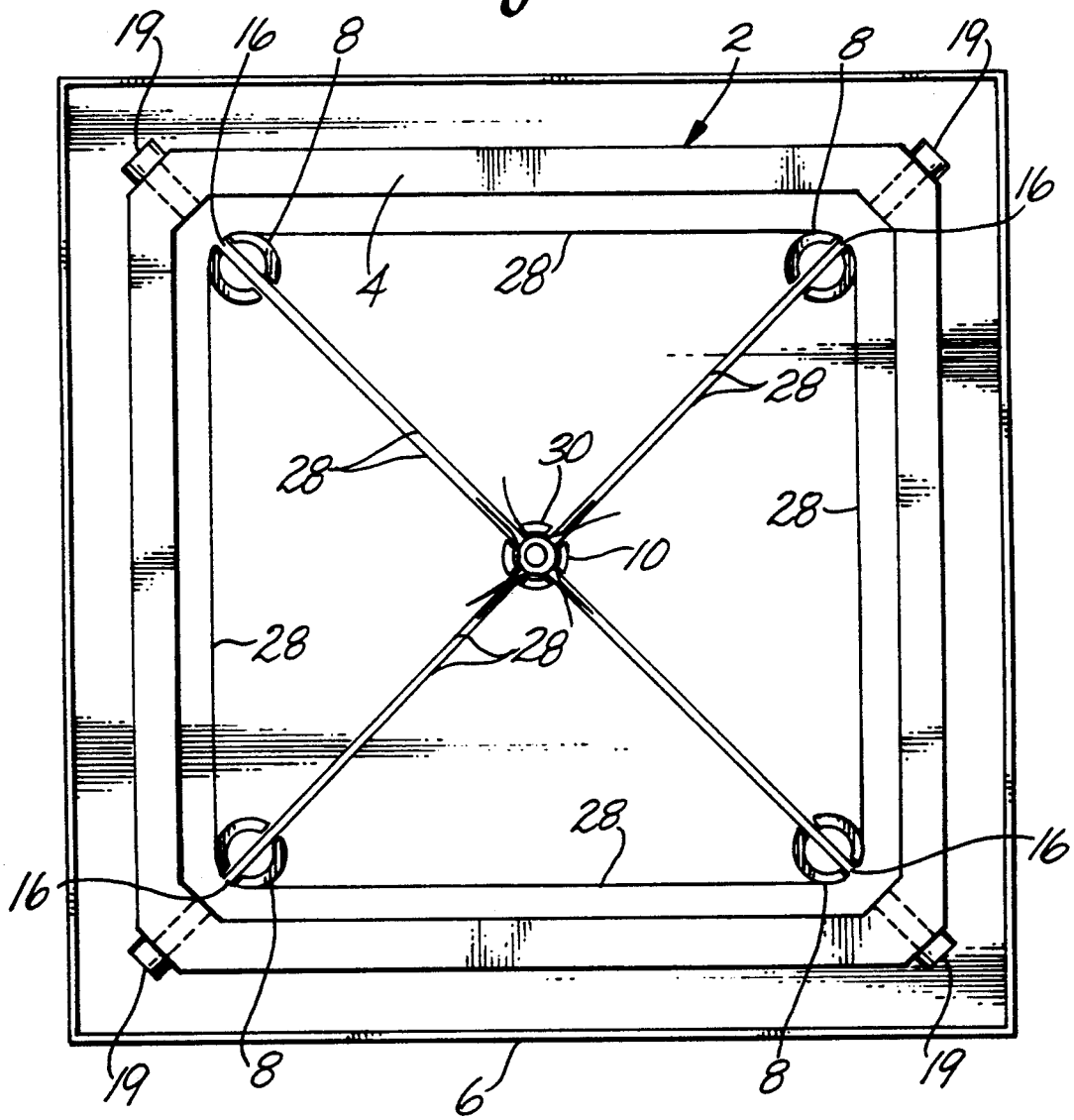
FIG. 1 is a top view of a pretensioned concrete slab mold, prior to concrete pouring.

A first embodiment of the invention is shown in FIG. 1. A concrete slab mold 2 includes a perimeter member which forms the outer boundary of the slab to be formed. The perimeter member rests on a pouring plate 6, which forms the bottom of the slab and provides a flat surface to contain the concrete when it is poured. Located adjacent each corner formed by the perimeter member are corner posts 8. At the intersection of the diagonals connecting the corner posts is a center post 10.

Figure 2:
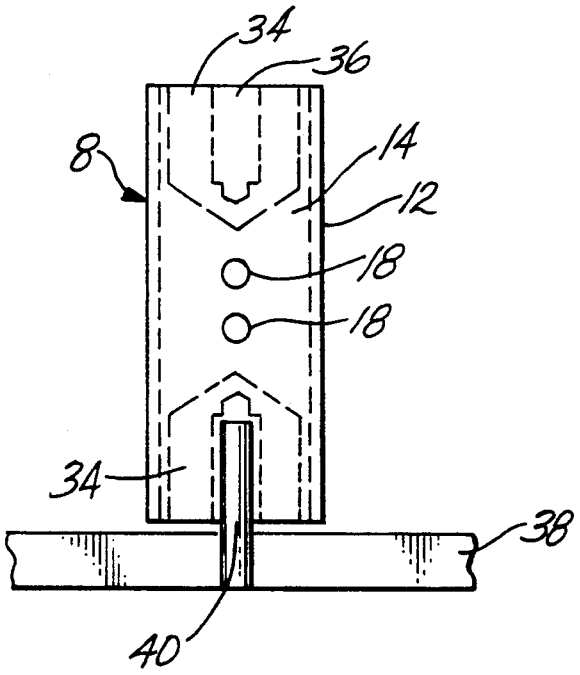
FIG. 2 is a side view of a corner post.
Figure 3:
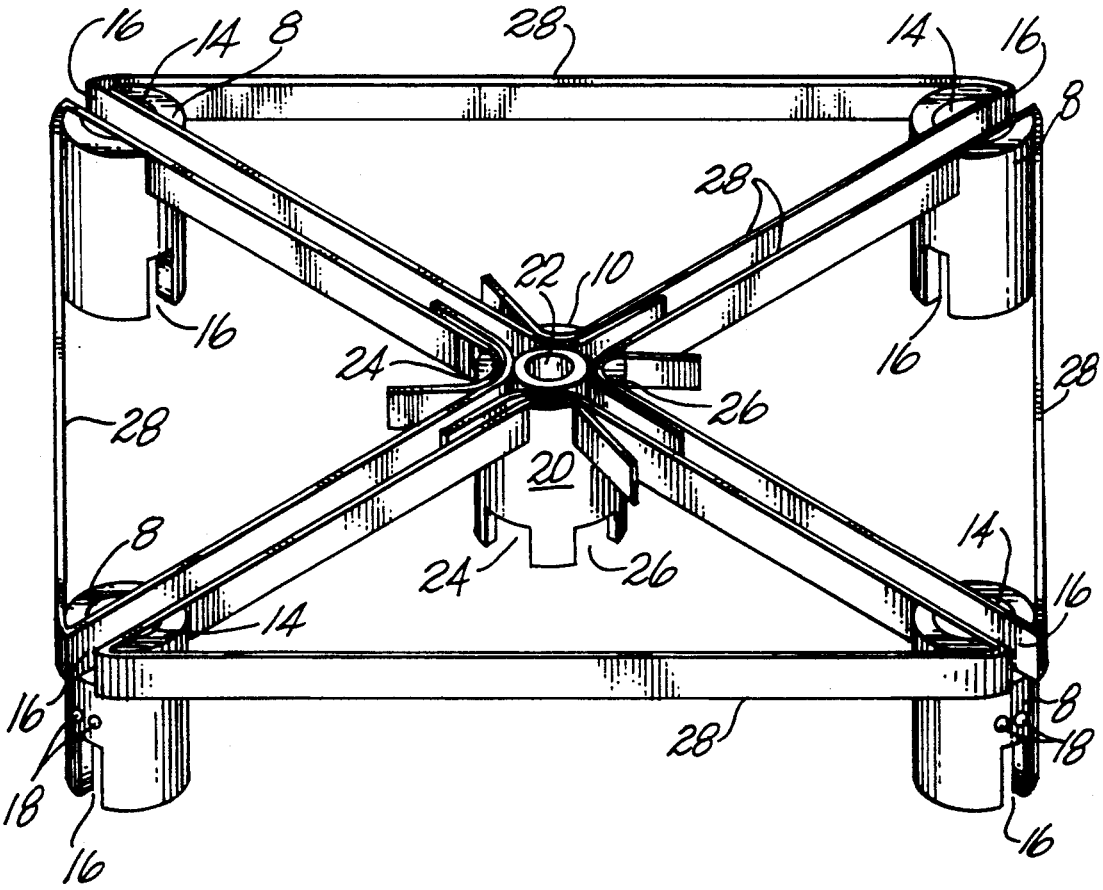
FIG. 3 is a side perspective of corner and center posts, with reinforcing members attached to the upper end of the posts.

Each of the corner posts, shown in FIGS. 2 and 3, is a cylinder 12 which includes a hollow core 14 through the cylinder. Parallel slots 16 are formed across the diameter of the upper and lower ends of the cylinder. Apertures 18 are located in the side of the cylinder and are aligned with the end of the slots. The corner posts are loosely attached to the perimeter member by screwing bolts 19, or other suitable tensioning device, through the perimeter member and into the apertures in the cylinder.

Each of the center posts 10, shown in FIG. 3, is a cylinder 20 which includes a hollow core 22 through the cylinder. A first set of parallel slots 24 are formed across the diameter of the upper and lower ends of the cylinder. A second set of parallel slots 26 are formed in the upper and lower ends of the cylinder and are perpendicular to the first set of slots. The center post is located at the intersection of the diagonals drawn between the corner posts. The center post and the corner posts are equal in height to the perimeter member so that, when the concrete slab is poured, the ends of the posts will be collinear with the outer surfaces of the slab.

The center and corner posts are preferably constructed from stainless steel or other suitable material.

The corner and center posts are attached to each other by reinforcing members 28. The reinforcing members are preferably steel strap. High tension plastic or composite fibre materials are alternatively used. A strip of reinforcing member is wrapped around the outer edges of two adjacent corner pieces and threaded through the slots in the upper end of the cylinders. The ends of the reinforcing material are then brought into two slots of the center post. The reinforcing member forms a triangle with two corner posts and the center post at each corner of the triangle. Each of the corner-post and center-post slots is wrapped in a similar fashion, to form four adjacent triangles.

The ends of the reinforcing members are placed in the slots of the center post inside the hollow core. A plug 30 is forced into the hollow core to secure the ends of the reinforcing members. The plug is forced into the hollow core until it is flush with the top of the center post.

The partially-assembled mold is then turned over, the remaining slots (the lower slots) on the corner and center post are wrapped with the reinforcing members, and the reinforcing members are secured in place as described previously for the upper slots.

When the wrapping of the reinforcing members around the center and corner posts is complete, the bolts 19 are tightened. As a result, the corner posts are drawn up against the corner of the perimeter member, tensioning the reinforcing members.

Eight plugs 34 are forced into each end of each of the corner posts until the tops of the plugs are flush with the ends of the corner posts. The plugs secure the reinforcing members into the corner posts and, also, tension further the reinforcing members. The plugs each contain a hole 36 extending into the core of the plug.

The assembly mold is placed on the pouring plate, and concrete is poured into the mold until it is flush with the upper end of the corner posts.

After the concrete is set and cured, the bolts are removed and the concrete slab is separated from the perimeter member.

The prestressed concrete slab is now ready for use.

The procedure for constructing the prestressed and pretensioned concrete slabs is simple and easy and does not require a high degree of skill or expensive equipment. The simplicity of the procedure makes it feasible to form the slabs on site, saving transportation and storage costs, and also makes it feasible for the home-improvement enthusiast to make the concrete slab. This method of forming prestressed slabs is suitable for making prestressed concrete slabs up to about three feet square.

Two uses for the prestressed slabs include ground cover and fencing.

Figure 4:
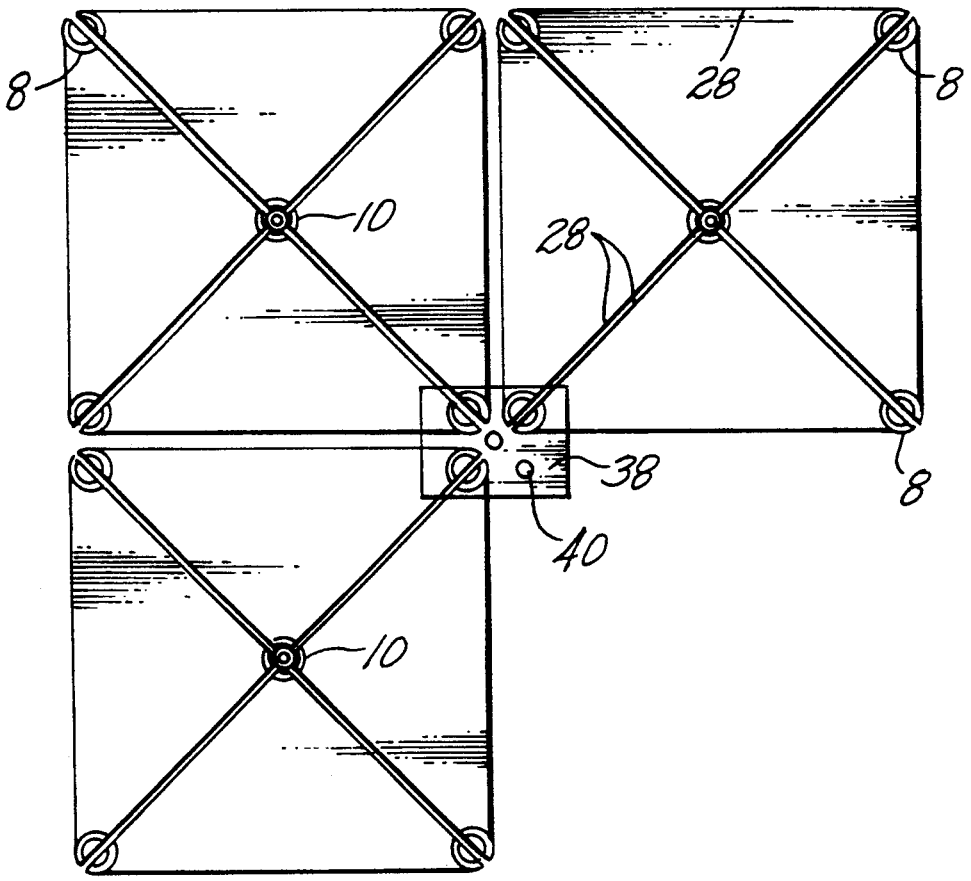
FIG. 4 is a top view of assembled slabs.

When used for ground cover, the slabs rest on poured concrete pilings. The tops of the pilings are poured to a level so that each of the pilings is on the same plane, forming a level plane on which the slabs are to be laid. Pouring the pilings is performed by using a pouring form, made level by four adjusting jacks. Concrete is poured through the hole, onto the ground, until the concrete is level with the top of the pouring form. A bolt or a bolt-securing device is placed in the center of the piling. The distance between the pilings is equal to the length of the sides of the prestressed slabs. A base plate 38, shown in FIGS. 2 and 4, is attached to the top of the pilings by a bolt or other suitable means of attachment.

The base plate comprises a flat plate with four protrusions 40 extending perpendicular to the surface of the plate. When the base plate is attached to the pilings, the protrusions extend in an upward direction from the base plate. The protrusions are spaced so that, when four slabs are aligned adjacent and corner-to-corner to each other, the protrusions align with each of the four holes 36 in the underside of the adjacent corner posts of the slabs. The slabs are attached to the base plate by slipping each of the holes in the lower end of the corner posts over each of the protrusions on four different-but-adjacent base plates attached to four adjacent pilings. Slabs are laid adjacent to each other in this fashion until the desired area is covered.

A second use for the prestressed concrete slabs is as a fencing material. A concrete footing is prepared. In the footing are placed two sets of flat anchoring plates, one set on each side of the footing. Holes are placed in the anchoring plates so that they align with the holes in the plugs inserted into the corner posts of two adjacent slabs. Bolts, or other similar attaching devices, are used to attach the slabs to the anchoring plates, bolting the first row of cement slabs to the footing. The slabs are attached to each other by using the base plates described for making a ground cover, except a plate is attached to both sides of the slab, and the base plates are attached to each other by passing a bolt, or other similar attaching device, through the base plates.

The embodiment described is for square, prestressed slabs, although the slabs could also be hexagonal or octagonal, etc. by changing the shape of the perimeter member and the slot orientation of the center post. For example, for a hexagonal slab, the slots in the center post would by spaced by 60 degrees from each other, rather than by 90 degrees for a square slab and by 45 degrees for an octagonal slab. Thus, this method of forming prestressed concrete slabs can be used for forming decorative designs, such as for patios and sidewalks.

Additionally, the upper ends of the center and corner posts could be covered in concrete, rather than being left exposed, to give a smooth upper surface.

Additional strength can be added to the slab by placing a reinforcing ring on the outside, around the ends of the center and corner posts, after the flat pieces of reinforcing materials have been inserted into the slots of the posts. When the pointed plugs are forced into the posts, the outside of the posts will tighten against the rings, holding them in place.

Also, alternate lacing patterns may be used, as desired.

The reinforcing members and the posts may also be molded as a single unit, ready for insertion into a mold.

Figure 5:
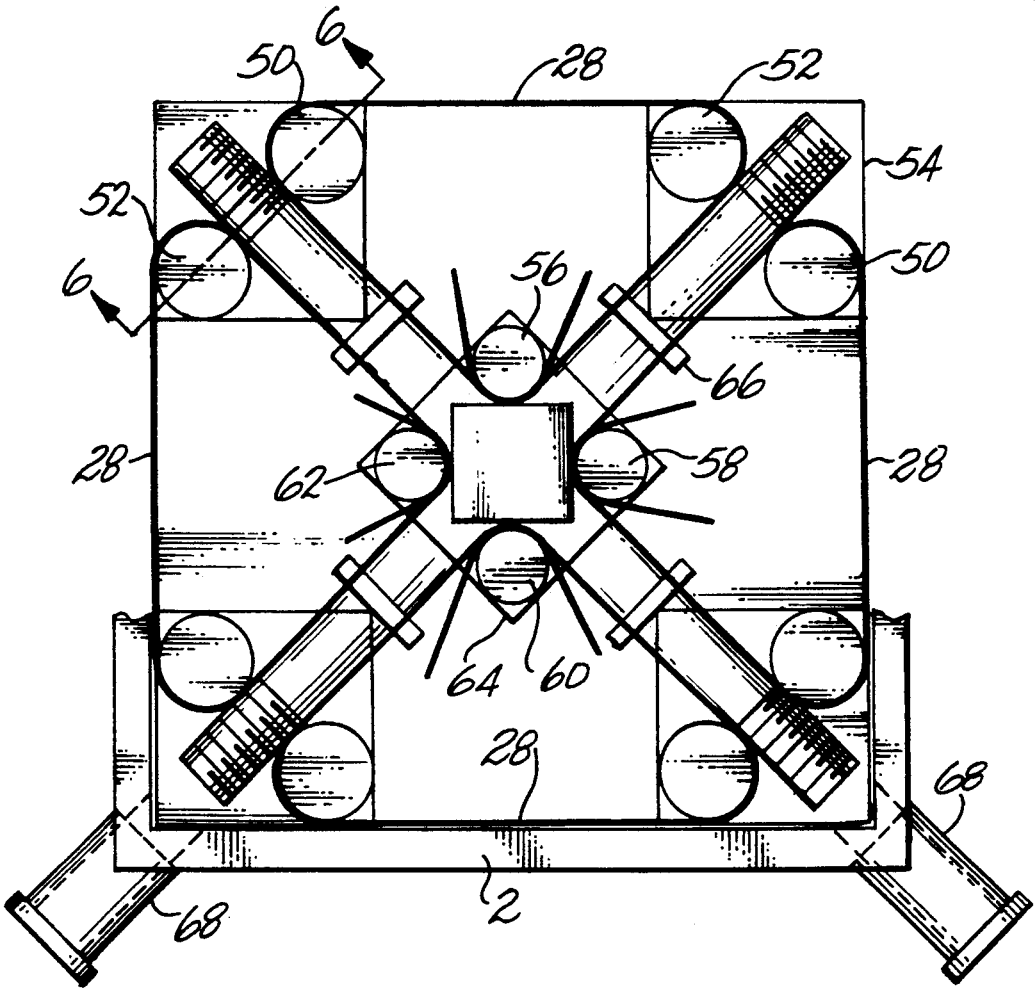
FIG. 5 is a top view of a second embodiment of the mold with plural corner tensioning posts.
Figure 6:
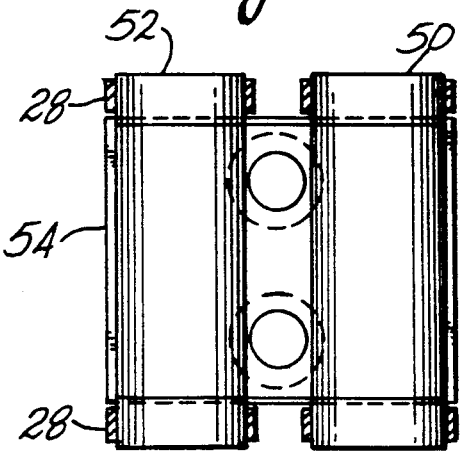
FIG. 6 is a view taken along line 6—6 in FIG. 5.

A second embodiment of the invention is shown in FIGS. 5 and 6. The second embodiment of the invention is designed to reduce stresses in the reinforcing members created by sharp corners as the reinforcing members are restrained by the corner posts and center post. As shown in FIG. 5 the single corner posts of the first embodiment are replaced by two cylinders 50 and 52 which are restrained in opposite corners of a square tube 54. The reinforcing members 28 extend around the cylinders 50 at adjacent corners of the slab, also extending inward along the diagonals of the slab to a center constraining means. The center constraining means replaces the center post of the first embodiment with four cylinders 56, 58, 60, and 62 which are constrained in corners of a square tube 64. As shown in FIG. 5 bolts 66 extending through apertures in the square tube 54 displace the cylinders 50 and 52 into the corners of square tube 54. A threaded cap 68 is inserted through apertures in the perimeter member 2 to engage the bolts for tensioning the square tube and captured cylinders toward the corner of the perimeter member. The reinforcing members are captured in the center of the slab by the four cylinders 56 through 62 and a square pin 70 which is force fit to urge the cylinders into the corners of square tubing 64 and frictionally engage the reinforcing members wrapped about the cylinders.

Interengagement of slabs formed in the second embodiment is accomplished with base plates as defined for the first embodiment wherein the protrusions 40 extend into the outboard corners of square tubing 54.

FIG. 6 demonstrates a refinement on the second embodiment employing two bolts 66 at each corner of the slab to space and tension the corner cylinders equally for upper and lower attachment of the reinforcing members.

Having now described the invention in detail as required by the patent statutes, those skilled in the art will recognize modifications and substitutions for elements in the present disclosure for specific embodiments or applications. It should be noted that while the disclosure demonstrates a square or rectangular embodiment of the invention, other geometrical forms such as pentagon, hexagon, or octagon shapes may be employed. These enhancements and modifications are contained within the scope and intent of the invention as defined in the following claims.

What is claimed is:

1. A prestressed concrete slab comprising:

a corner post at each corner of the slab, the corner post comprising:

a first cylindrical member having a cylindrical open core;

at least one slot across the diameter of each an upper end and a lower end of the first cylindrical member; and at least one aperture in the side of the cylindrical member;

a center post at the intersection of the diagonals drawn from the corner posts, the center post comprising:

a second cylindrical member having a cylindrical open core; and at least two slots across the diameter of each end of the second cylindrical member where a first slot is at a right angle to a second slot;

reinforcing members wrapped around the corner posts and through the slots on an upper end of the corner posts and through the slots on the upper end of the center posts to connect each to the other;

reinforcing members wrapped around the corner posts and through the slots on a lower end of the corner posts and through the slots on the lower end of the center posts to connect each to the other;

a plug inserted into the upper end and the lower end of the cylindrical core of each of the corner and center posts to retain and secure the reinforcing members; and concrete set and cured around and between the corner posts and around the center posts and the reinforcing members.

2. A prestressed concrete slab as recited in claim 1, wherein the corner posts, the center posts and the plugs are constructed of stainless steel.

3. A prestressed concrete slab as recited in claim 1, wherein the reinforcing members comprise flat strips of steel.

4. A prestressed concrete slab comprising:

a corner post at each corner of the slab, each corner post comprising:

a first cylindrical member;

means of attaching and securing reinforcing members to the corner posts; and means of attaching each slab to another slab;

a center post, the center post comprising:

a second cylindrical member; and means of attaching and securing reinforcing members to the center post;

reinforcing members attached to the corner posts and the center post to connect each to the other; and concrete set and cured around and between the corner posts and around the center post and the reinforcing members permanently embedding the corner posts, center post and reinforcing members in said concrete slab.

5. A prestressed concrete slab as recited in claim 4, wherein the means of attaching the reinforcing members to the corner posts comprises a plug forced into a hollow core of the corner posts.

6. A prestressed concrete slab as recited in claim 4, further including means of attaching the slabs to each other comprising:

a plate having protrusions perpendicular to the plane of the plate; and cavities in the corner posts configured to accept the protrusions of the plate.

7. A prestressed concrete slab as recited in claim 4, wherein the means of attaching the reinforcing members to the center post comprises a plug forced into a core of the center post.

8. A prestressed concrete slab as recited in claim 4, wherein the corner posts, the center posts and the plugs are constructed of stainless steel.

9. A prestressed concrete slab as recited in claim 4, wherein the reinforcing members are flat strips of steel.

10. A prestressed concrete slab comprising:

a plurality of corner members, each corner member having a surface for engaging a reinforcing member and means for tensioning the corner member to a mold frame;

a center member having a plurality of surfaces for engaging reinforcing members and constraining means for frictionally urging reinforcing members to said surfaces;

reinforcing members extending around the engaging surfaces of at least two corner members, and one of the engaging surfaces of the center member; and, concrete set and cured around and between the corner posts and around the center post and the reinforcing members.

11. A prestressed concrete slab as defined in claim 10 wherein the corner members each comprise:

a square tube and two cylinders, the cylinders urged into opposing corners of the square tube by a bolt extending through the square tube, the bolt in conjunction with a threaded cap extending through a mold wall comprising the tensioning means, and the surface of the cylinders comprising the surface for engagement of the reinforcing member and wherein the center member comprises:

a square tube and four cylinders, the engaging surface of the center member comprising the surfaces of the four cylinders and the constraining means comprising a square pin centrally inserted in the square tube to urge the cylinders to the four corners of the tube and frictionally engage the reinforcing member on the surface of each cylinder and wherein the reinforcing member comprises flat steel strapping.

* * * * *